US006616856B1

(12) United States Patent
Pacifici et al.

(10) Patent No.: US 6,616,856 B1
(45) Date of Patent: Sep. 9, 2003

(54) NYLON FIBER PROTECTIVE FINISHING COMPOSITIONS AND METHODS OF MANUFACTURING SAME

(75) Inventors: Joseph A. Pacifici, Anderson, SC (US); Daniel G. Sims, Greer, SC (US)

(73) Assignee: Simco Products, Inc., Greenville, SC (US)

( * ) Notice: Subject to any disclaimer, the term of this patent is extended or adjusted under 35 U.S.C. 154(b) by 0 days.

(21) Appl. No.: 10/068,336

(22) Filed: Feb. 6, 2002

Related U.S. Application Data

(60) Provisional application No. 60/267,309, filed on Feb. 8, 2001.

(51) Int. Cl.[7] ..... D06M 15/256

(52) U.S. Cl. ..... 252/8.62; 252/8.61; 252/8.81

(58) Field of Search ..... 252/8.61, 8.62, 252/8.81

(56) References Cited

U.S. PATENT DOCUMENTS

| | | | | | |
|---|---|---|---|---|---|
| 4,822,373 | A | | 4/1989 | Olson et al. | 8/115 |
| 4,857,392 | A | * | 8/1989 | Kirjanov et al. | 442/94 |
| 4,937,123 | A | * | 6/1990 | Chang et al. | 428/96 |
| 5,349,038 | A | * | 9/1994 | Plischke et al. | 528/150 |
| 5,464,584 | A | * | 11/1995 | Yeh | 264/103 |
| 5,843,328 | A | | 12/1998 | Pacifici et al. | 252/62 |
| 5,952,409 | A | | 9/1999 | Boardman et al. | 524/185 |
| 6,197,378 | B1 | | 3/2001 | Clark et al. | 427/377 |
| 6,488,893 | B1 | * | 12/2002 | Elgarhy et al. | 422/93 |

* cited by examiner

*Primary Examiner*—Anthony J. Green
(74) *Attorney, Agent, or Firm*—Baker Donelson

(57) ABSTRACT

A protective finishing composition for protecting nylon fibers comprises an aqueous mixture of a sulfonated aromatic aldehyde condensation stainblocker, a methacrylate stainblocker, a fluorocarbon-based repellant emulsion, and a naphthalene sulfonated salt fluorocarbon anti-coalescing agent in an amount effective to prevent said fluorocarbon based repellant emulsion from coalescing in the presence of the stainblockers.

1 Claim, No Drawings

NYLON FIBER PROTECTIVE FINISHING COMPOSITIONS AND METHODS OF MANUFACTURING SAME

REFERENCE TO RELATED APPLICATION

This is a continuation in part of provisional application Ser. No. 60/267,309 filed Feb. 8, 2001.

TECHNICAL FIELD

The present invention relates to compositions for use in finishing and protecting nylon fibers and to methods of manufacturing such compositions.

BACKGROUND OF THE INVENTION

Carpets today are commonly formed of polyamide fibers such as nylon that are woven into yarns and tufted. The tufted material is then colored with dyes and finished with softeners, fixing agents, stainblockers and fluorocarbon soil repellents. Until the middle 1980s, the primary carpet finishing process was the application of fluorocarbon polymer emulsions which imparted water and oil repellency. These fluorocarbon products were sprayed or foamed into the carpet fibers. At that time, however, nylon carpets were still susceptible to staining by natural and artificial acidic colorants commonly found in many foods and drinks such as in red wine, Kool Aid and coffee.

Due to the need to provide acid colorant stain protection in nylon carpet, a finishing technique was introduced to the carpet industry by DuPont under the name Stain Master in the middle 1980s. The Stain Master fit technique involves the application of sulfonated polymers known either as snytans, sulfonated novolacs, or sulfonated aromatic aldehyde condensation products (SAC) to carpet products. These colorless, polymeric, aromatic sulfonates are commonly referred to as "stainblockers" in the carpet industry. Stainblockers are generally water soluble anionic polymers with some being formulated with methacrylate polymers. Such polymeric salts are regularly described in articles of the American Association of Textile Chemists and Colorists (AATCC) magazine, the *Textile Chemist and Colorist*, an example of which is entitled Stain Resist Chemistry for Nylon 6 Carpet from the November 1989 issue, Volume 21, Number 11.

Currently, during manufacture, nylon carpets are conveyed onto continuous dye machines in which the stainblockers, for stain resistance, and fluorocarbons, for anti-soiling, are applied to the fabrics in two separate steps. Sulfonated stainblockers and fluorocarbons had not been capable of being applied in a single step since fluorocarbon emulsion repellents coalesce in the presence of stainblockers.

In order to minimize the need for equipment, manpower, and overhead as a result of implementing two separate finishing processes, efforts continued to consolidate the two finishing processes into one. To this end, U.S. Pat. No. 4,875,901 to Payet et. al. disclosed a single step method in which nylon fibers were imparted with stain resistance, and water and oil repellency by contacting the fiber with an aqueous solution of a stainblocker, a fluorocarbon, and a divalent metal salt. Although Payet et. al. does disclose a single step process, the process has not gained commercial acceptance, primarily due to the resultant carpet water and oil repellency being inconsistent and often below acceptable industry standards. This inconsistency results from the stainblocker's tendency to interfere with the fluorocarbon curing process, that process being a thermal reorientation of the fluorocarbon molecules.

When fluorocarbon emulsion products are mixed with stainblockers, the fluorocarbon emulsion destabilizes and a semi-solid mass forms. This is due to the fluorocarbon emulsion contacting the stainblocker. It is well known that emulsions are easily destabilized by the addition of salts. Essentially, the salts act as a coalescing agent causing an agglomeration of the emulsion. Since stainblockers are a form of salt, they destabilize the fluorocarbon emulsions as would a common salt. For instance, the addition of sodium chloride or sodium sulfate to a fluorocarbon emulsion results in the destabilization of the fluorocarbon emulsion and the formation of an unusable semi-solid mass.

Payet et. al. relies on the proposition that in a dilute aqueous solution the destabilizing effect should not occur, so that the stainblocker polymers and fluorocarbon polymer emulsions should give the same results in a one step application process as they do in a two step application process. Although this proposition applies to chemical combinations which fix or cure in aqueous solutions, such as stainblockers, it does not apply to chemical combinations which require heat for curing and which consequently cause the evaporation of water. For instance, in fluorocarbon polymer combinations which require heat for curing, the addition of salt adversely affects the fluorocarbon polymer performance. If a chemical combination includes one chemical requiring heat for curing, and that chemical combination is not compatible when mixed in concentrated form, poor performance will result even if the chemicals are compatible in dilute aqueous form. The rationale here is that as water evaporates from the dilute solution, the concentrations of the chemicals increase until they finally reach a level in which they are incompatible. In carpet products this occurs on the fibers and, though not visually observed, the adverse affect on the carpet can be measured by standard test methods. In a fluorocarbon/stainblocker polymer combination, it is always the performance of the fluorocarbon that is affected rather than that of the stainblocker. It is likely that these adverse effects result from the fluorocarbon having to be heat cured to give performance results, while stainblockers normally fix under aqueous conditions.

Improved stain resistance of carpets has remained an important but elusive industry objective as measurable by AATCC Test Method 175-1992. Water and oil repellency, however, has since the mid 1980s been dominated by the desired property of carpets to resist soiling, as measured by AATCC test methods 122-1989 and 123-1989, and the ability of a carpet to be cleaned, as measured by AATCC test method 171-1989. Just as in water and oil repellency, soil resistance (anti-soiling) and cleaning are achieved by the use of anionic and non-ionic fluorocarbon emulsions. They are both liquids dispersed in immiscible liquids in colloidal size liquid droplets. Therefore, these carpet finishes continue to be applied in a two-step process with stainblockers in order to avoid the formation of the before mentioned mass.

More recently it was discovered that when a naphthalene sulfonated salt is added to a combination of a stainblocker and at least one type of fluorocarbon-based repellant, the naphthalene sulfonated salt functions as a fluorocarbon anti-coalescing agent. As explained in U.S. Pat. No. 5,843,328, the resultant composition is stable for a lengthy period of time, forming a product that gives acceptable stain and soil resistance in nylon carpet fibers and yarns. The composition is produced by mixing the naphthalene sulfonated salt with at least one fluorocarbon-based repellant and then mixing the resulting combination with a stainblocker. Alternatively, the naphthalene, sulfonated salt is mixed with the stainblocker and then the resulting combination mixed with the fluorocarbon-based repellant(s). Either way the result is a chemical composition that provides both fluorocarbon-based repellency (either water and oil repellency, soiling or cleaning repellency, or a combination thereof) and stainblocker protection, without agglomeration of the fluorocarbon-based repellant(s). The naphthalene sulfonated salt effectively slows down the agglomeration process to allow for the curing of both the stainblocker and the fluorocarbon-based repellant.

Unfortunately, the stainblockers disclosed in U.S. Pat. No. 5,843,328 tend to yellow when exposed to light, ozone, and/or nitrogen oxide gases. This can become a problem on light shades of carpets. This yellowing problem on light shades of carpet caused by sulfonated stainblockers was earlier addressed in U.S. Pat. No. 4,937,123. That patent teaches that the use of polymethacrylic acid, copolymers of methacrylic acid and combinations thereof, all here defined as methacrylate type, impart to polyamide fibers improved stain resistance to acid colorants such as those found in food and drink products.

Methacrylate type stainblockers have advantages. Firstly, they do not yellow when exposed to light, ozone, and nitrogen oxides gases. Secondly, they are stable when mixed in combination with a fluorocarbon based repellant emulsion. Therefore, they do not require the need for a naphthalene sulfonated salt as an anti-coalescing agent. The main disadvantages of methacrylate type stainblockers are that they perform poorly as a stainblocker on some types of nylon polyamide fibers, and are not very durable to foot traffic and cleaning on carpet.

These problems were addressed in U.S. Pat. No. 4,822,373 which disclosed the use of a combination of stainblockers disclosed in U.S. Pat. Nos. 5,843,328 and 4,937,123. Using the sulfonated type stainblockers in combination with the methacrylate type was found to provide better performance and durability while minimizing yellowing. The level of each type of stainblocker in a mix practiced today in the industry is generally 20–50 w/w % of the sulfonated type and 50–80 w/w % of the methacrylate type. The main disadvantage of the combination of the sulfonate type stainblockers and the methacrylate type stainblockers is they cannot be used in conjunction with a fluorocarbon repellant emulsion without coalescing and forming a mass. For example, when a 30/70% sulfonated/methacrylate stainblocker is mixed with a fluorocarbon to form a nylon fiber protective finish, the product combination becomes unstable and forms a mass.

SUMMARY OF THE INVENTION

It has now been found that when a naphthalene sulfonated salt is added to a sulfonated/methacrylated stainblocker mix, and the combination then added to a fluorocarbon based repellent emulsion, an effective, stable nylon fiber protective finishing composition is formed without the appearance of a coalescing mass that remains stable for a substantial period of time and with minimal yellowing. Alternatively, the naphthalene sulfonated salt can be added to the fluorocarbon repellent emulsion and the combination then added to the sulfonated/methacrylated stainblocker mix.

DETAILED DESCRIPTION

EXAMPLE 1.

The fluorocarbon repellant emulsions were APG-503 (FE-1) and APG-3720(FE-2) from Daikin. The sulfonated type stainblocker (SSR) was from Simco Products. The methacrylate type stainblockers were 668F (MSB-1) from 3M and NYB (MSB-2) from CIBA. The naphthalene sulfonated salt Petro AA (liq) (NSS)was from Witco. Table 1 shows which mixes were stable (s) and which were not (u).

TABLE 1

| | Mixes % | | | | | | | | | | | |
|---|---|---|---|---|---|---|---|---|---|---|---|---|
| Product | 1 | 2 | 3 | 4 | 5 | 6 | 7 | 8 | 9 | 10 | 11 | 12 |
| SSB | | | | | 25 | 25 | 25 | 25 | 20 | 20 | 20 | 20 |
| MSB-1 | 70 | 70 | | | 50 | 50 | | | 40 | 40 | | |
| MSB-2 | | | 70 | 70 | | | 50 | 50 | | | 40 | 40 |
| NSS | | | | | | | | | 15 | 15 | 15 | 15 |
| FE-1 | 30 | | 30 | | 25 | | 25 | | 25 | | 25 | |
| FE-2 | | 30 | | 30 | | 25 | | 25 | | 25 | | 25 |
| Stability | S | S | S | S | U | U | U | U | S | S | S | S |

As seen from Table 1, those mixes where the stainblocker was a methacrylate type (mixes 1–4) the stability was very good. Those mixes where the stainblocker was a sulfonated/methacrylated combination without a naphthalene sulfonated salt (mixes 5–8) the stability was poor. Those mixes where the stainblocker was a sulfonated/methacrylated combination, also combined with a naphthalene sulfonated salt (mixes 9–12), the stability was also very good.

EXAMPLE 2.

Mix no. 3 and mix no. 11 from Table 1 were tested for durability of stain resistance using AATCC test method 175. Type 6 non-heat set solution dyed carpet samples were treated at a 1% application level, dried and cured at 350° F. for two minutes. The stain resistance was tested in the following manner. One set of samples was tested for initial stain resistance. A second set was washed for five minutes in hot water (132° F.), extracted and dried. A third set was cleaned five times with a hand carpet cleaner using a mild carpet cleaner (Americlean 2003). A fourth set was cleaned five times with a hand carpet cleaner using a harsh cleaner (Rugdoctor with Spotblock). Table 2 shows the results on a scale from 1 to 10 where 1 denotes sever staining and 10 denotes no staining.

TABLE 2

| AATCC Test Method 175 | | | | |
|---|---|---|---|---|
| Mix No. | Initial | Washed | Cleaned (mild) | Cleaned (harsh) |
| Control | 1 | NA | NA | NA |
| 3 | 10 | 8 | 9 | 5 |
| 11 | 10 | 10 | 10 | 8 |

These results show that the combination of the sulfonated and methacrylate stainblocker demonstrated by mix 11 gave better durability than the methacrylate stainblocker demonstrated by mix 3.

Although the invention has been described and illustrated in its preferred form, it should be understood that many modifications, changes or additions may be made thereto without departure from the spirit and scope of the invention as set forth in the following claim. It should also be understood that the terminology used herein is intended to be consistent with that of our prior U.S. Pat. No. 5,843,328.

What is claimed is:

1. A protective finishing composition for protecting nylon fibers comprising an aqueous mixture of a sulfonated aromatic aldehyde condensation product stainblocker, a methacrylate stainblocker, a fluorocarbon-based repellant emulsion, and a naphthalene sulfonated salt fluorocarbon anti-coalescing agent in an amount effective to prevent said fluorocarbon based repellant emulsion from coalescing in the presence of said stainblockers.

* * * * *